US007832993B2

(12) United States Patent
Erfurt

(10) Patent No.: US 7,832,993 B2
(45) Date of Patent: Nov. 16, 2010

(54) INTERNAL COMBUSTION ENGINE HAVING A COMPRESSOR AND A PRESSURE DAMPER

(75) Inventor: Jakob Erfurt, Ehra-Lessien (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 208 days.

(21) Appl. No.: 11/711,257

(22) Filed: Feb. 26, 2007

(65) Prior Publication Data

US 2007/0144499 A1 Jun. 28, 2007

Related U.S. Application Data

(63) Continuation of application No. PCT/EP2005/005828, filed on May 31, 2005.

(30) Foreign Application Priority Data

Aug. 26, 2004 (DE) ..... 10 2004 041 228

(51) Int. Cl.
*F04B 17/05* (2006.01)
*F04B 35/01* (2006.01)

(52) U.S. Cl. ..... 417/360; 417/312; 123/559.1; 60/605.3; 415/213.1; 415/214.1

(58) Field of Classification Search ..... 417/364, 417/312, 360; 123/559.1, 565; 60/605.3; 415/213.1, 214.1
See application file for complete search history.

(56) References Cited

U.S. PATENT DOCUMENTS

| | | | | |
|---|---|---|---|---|
| 2,434,248 | A * | 1/1948 | Mucher | 403/167 |
| 3,859,968 | A | 1/1975 | Stinebaugh | |
| 4,372,120 | A * | 2/1983 | Ford et al. | 60/605.1 |
| 4,445,336 | A * | 5/1984 | Inoue | 60/605.1 |
| 5,090,392 | A * | 2/1992 | Nakano et al. | 123/564 |
| 5,140,816 | A * | 8/1992 | Scicluna | 60/605.1 |
| 5,448,982 | A | 9/1995 | Arakawa et al. | |
| 5,624,099 | A | 4/1997 | Spies et al. | |
| 5,979,598 | A | 11/1999 | Wolf et al. | |
| 6,012,436 | A | 1/2000 | Boutcher | |
| 7,229,061 | B2 * | 6/2007 | Battig et al. | 248/677 |
| 7,240,892 | B2 * | 7/2007 | Battig | 248/677 |
| 2007/0101713 | A1 * | 5/2007 | Battig et al. | 60/598 |
| 2010/0040465 | A1 * | 2/2010 | Moran et al. | 415/213.1 |
| 2010/0040467 | A1 * | 2/2010 | Mudel | 415/214.1 |

FOREIGN PATENT DOCUMENTS

| | | | |
|---|---|---|---|
| DE | 35 31 353 | C2 | 3/1987 |
| DE | 196 15 917 | A1 | 10/1997 |
| DE | 100 36 130 | A1 | 7/2002 |
| EP | 1 170 478 | A2 | 1/2002 |
| EP | 1 291 570 | A2 | 3/2003 |
| EP | 1 428 999 | A1 | 6/2004 |
| GB | 2050507 | A * | 1/1981 |
| JP | 04 303 124 | A | 10/1992 |
| JP | 06 108942 | A | 4/1994 |
| JP | 11-294276 | A | 10/1999 |

* cited by examiner

*Primary Examiner*—Charles G Freay
*Assistant Examiner*—Patrick Hamo
(74) *Attorney, Agent, or Firm*—Manfred Beck, P.A.

(57) ABSTRACT

An internal combustion engine includes a cylinder crankcase, a mechanically driven compressor for compressing charge air, and a compressor mounting for the compressor. The compressor mounting is provided at the cylinder crankcase and a pressure damper is integrated into the compressor mounting.

4 Claims, 6 Drawing Sheets

INTERNAL COMBUSTION ENGINE HAVING A COMPRESSOR AND A PRESSURE DAMPER

CROSS-REFERENCE TO RELATED APPLICATIONS

This application is a continuation, under 35 U.S.C. §120, of copending International Application No. PCT/EP2005/005828, filed May 31, 2005, which designated the United States; this application also claims the priority, under 35 U.S.C. §119, of German Patent Application No. DE 10 2004 041 228.6, filed Aug. 26, 2004; the prior applications are herewith incorporated by reference in their entirety.

BACKGROUND OF THE INVENTION

Field of the Invention

The invention relates to an internal combustion engine having a cylinder crankcase, a mechanically driven compressor for compressing charge air, a compressor mounting for the compressor at the cylinder crankcase and a pressure damper.

European Patent Application Publication No. EP 1 170 478 A2 discloses an internal combustion engine with a compressor, an intake manifold and a charge air cooler provided between the compressor and the intake manifold. The compressor and the charge air cooler have a common, integrally cast housing part, wherein this housing part is fastened to the intake manifold or, optionally, the intake manifold is also integrally formed with the housing part. This achieves a noise reduction in the area of the compressor. Additionally, a response time of the internal combustion engine with charge air cooling is improved by the compact configuration and the resulting small air volume between the compressor and the intake manifold.

German Patent Application Publication No. DE 196 15 917 A1 discloses an intake silencer for an internal combustion engine with a charger, wherein the intake silencer is for example integrated in a pressure pipe joint of the charger.

SUMMARY OF THE INVENTION

It is accordingly an object of the invention to provide an internal combustion engine which overcomes disadvantages of the heretofore-known internal combustion engines of this general type and which improves the construction and layout in the area of the compressor and the pressure damper.

With the foregoing and other objects in view there is provided, an internal combustion engine, including:

a cylinder crankcase;

a mechanically driven compressor for compressing charge air;

a compressor mounting for the compressor, the compressor mounting being provided at the cylinder crankcase; and a pressure damper integrated into the compressor mounting.

In other words, according to the invention, there is provided an internal combustion engine with a cylinder crankcase, a mechanically driven compressor for compressing charge air, a compressor mounting for the compressor at the cylinder crankcase, and a pressure damper, wherein the pressure damper is integrated into the compressor mounting. This has the advantage that, through the use of fewer parts, the complexity and thus the expenditure for assembly as well as costs are reduced.

According to another feature of the invention, the pressure damper includes a mounting part, a damper cover fastened to the mounting part, and an inset part disposed between the mounting part and the damper cover.

According to yet another feature of the invention, the mounting part is fastened to the cylinder crankcase; and the compressor is fastened to the mounting part.

According to an alternative feature of the invention, at least one fastening device, which reaches through the compressor and through the mounting part, fastens the compressor together with the mounting part at the cylinder crankcase. In other words, the compressor and the mounting part are jointly fastened at the cylinder crankcase through the use of at least one fastening device that extends through the compressor and the mounting part.

According to an another alternative feature of the invention, the damper cover is formed in one piece, i.e. integrally, with the cylinder crankcase.

Other features which are considered as characteristic for the invention are set forth in the appended claims.

Although the invention is illustrated and described herein as embodied in an internal combustion engine having a compressor and a pressure damper, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
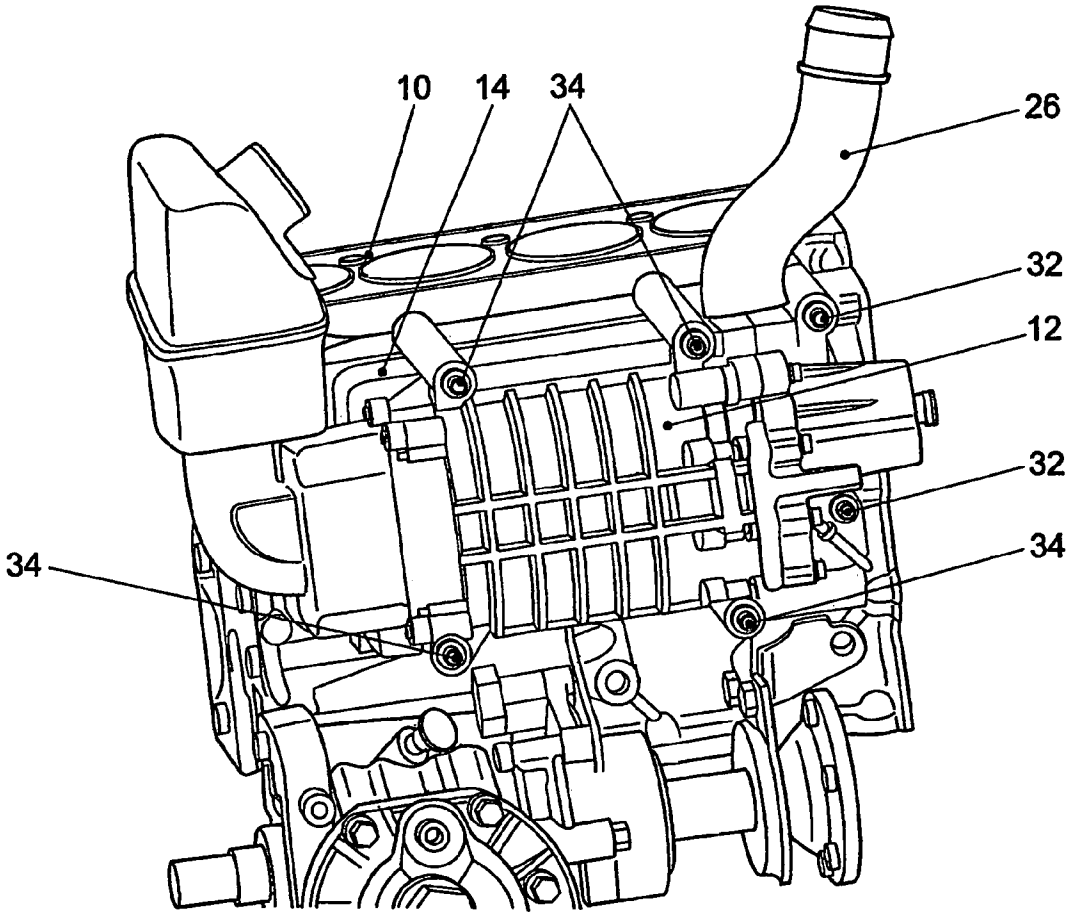
FIG. 1 is a perspective view of a first preferred embodiment of an internal combustion engine according to the invention.

Referring now to the figures of the drawings in detail and first, particularly, to FIG. 1 thereof, there is shown a preferred embodiment of an internal combustion engine which includes a cylinder crankcase 10, a mechanically driven compressor 12 for compressing charge air and a compressor mounting 14 for the compressor 12 at the cylinder crankcase 10.

Figure 3:
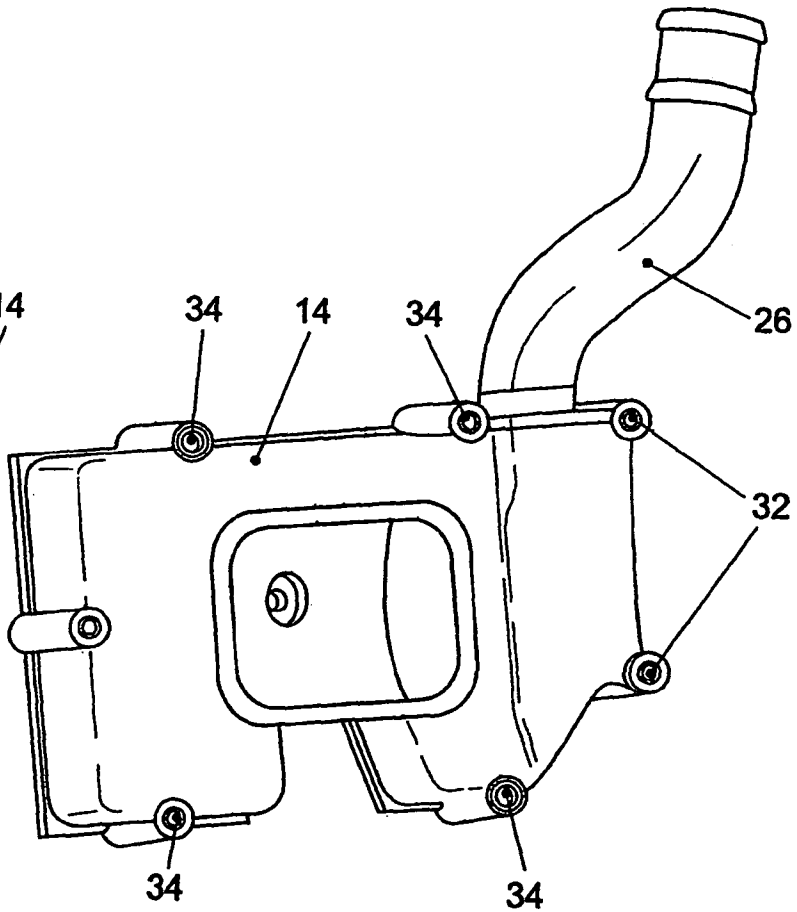
FIG. 3 is a further perspective view of the mounting part of the pressure damper of FIG. 2 in accordance with the invention.
Figure 2:
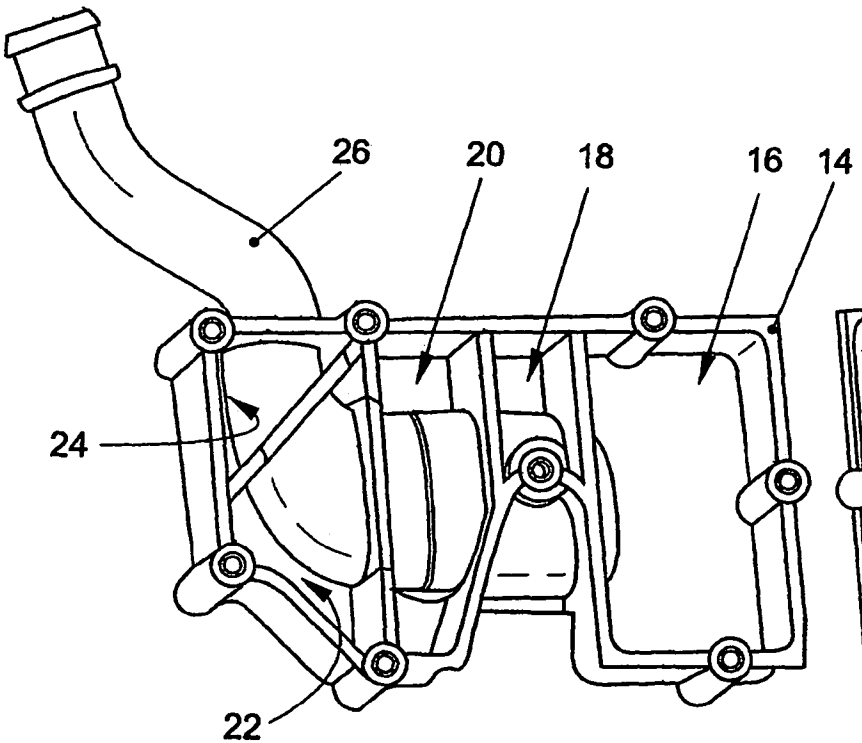
FIG. 2 is a perspective view of a mounting part of the pressure damper of the first preferred embodiment of the internal combustion engine of FIG. 1 in accordance with the invention.
Figure 4:
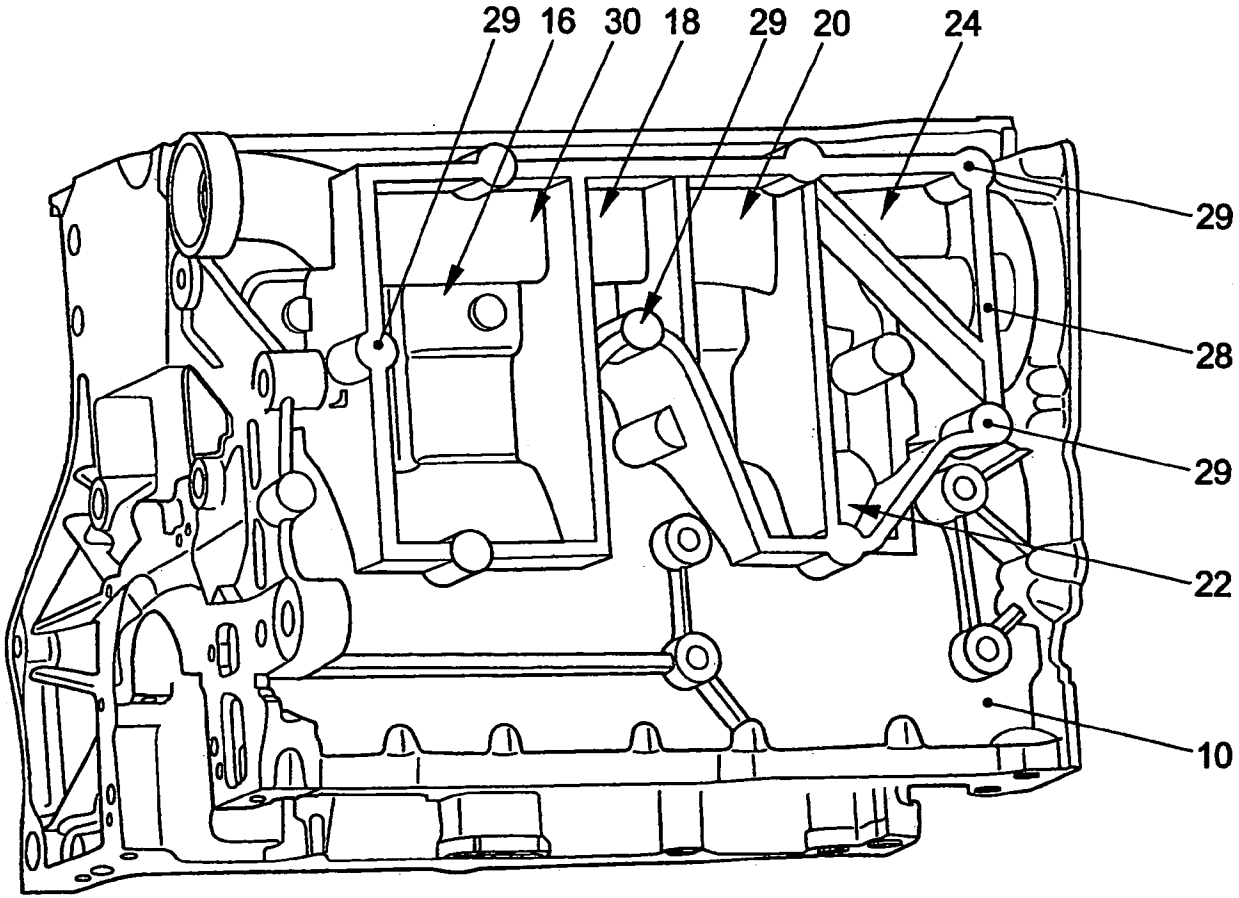
FIG. 4 is a perspective view of a cylinder crankcase of the first preferred embodiment of the internal combustion engine of FIG. 1 in accordance with the invention.
Figure 5:
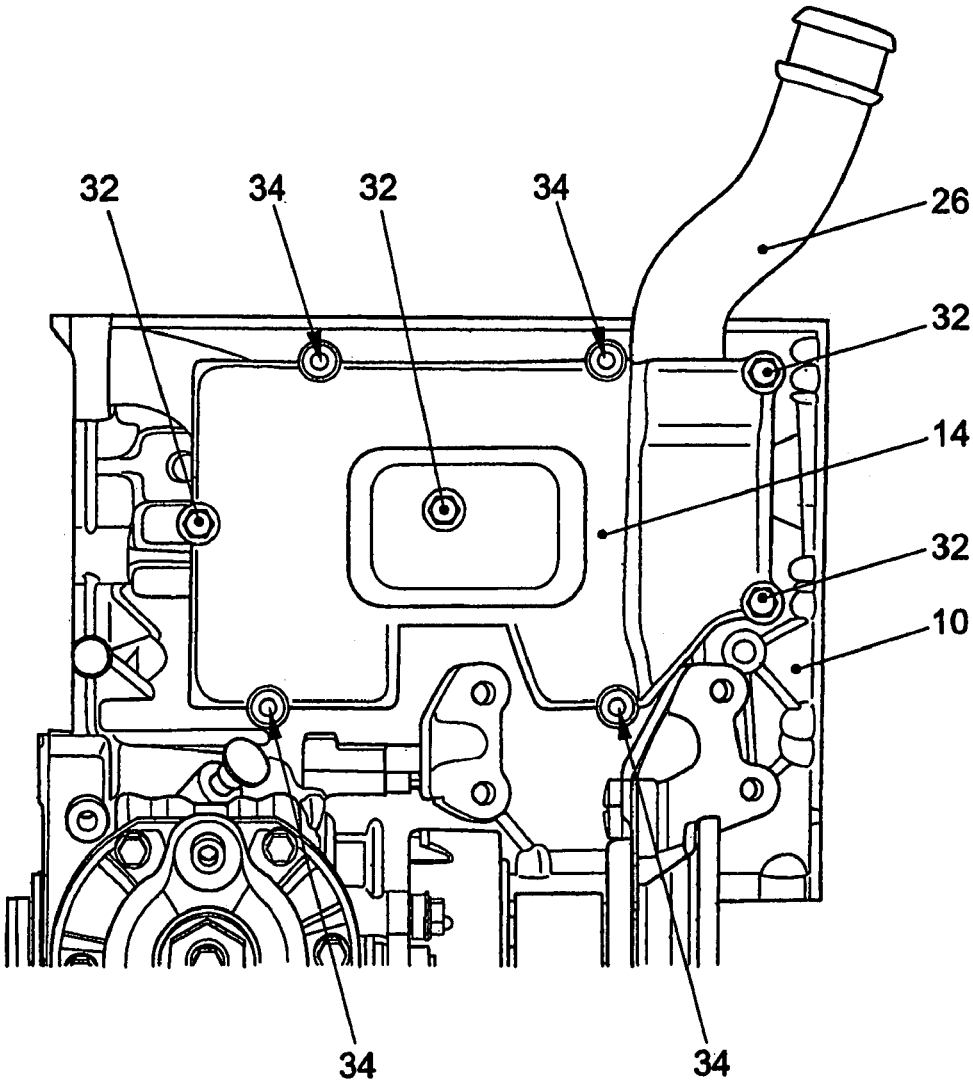
FIG. 5 is a perspective view of a cylinder crankcase according to FIG. 4 with an installed mounting part according to FIGS. 2 and 3 in accordance with the invention.

As can be seen in FIGS. 2 and 3, a pressure damper with several chambers 16 to 24 and an inset part 26 for guiding air is integrated into the compressor mounting 14. This pressure damper serves to suppress noise emissions and includes a damper cover 28 which partly forms the chambers 16 to 24 and closes off these chambers, wherein the damper cover 28 is formed together with the cylinder crankcase 10 as one piece, i.e. the damper cover 28 is formed integrally with the cylinder crankcase 10, as can be seen in FIG. 4. A water pipe 30 is cast into the cylinder crankcase 10 in the area of the damper cover 28. As can be seen in FIGS. 4 and 5, the compressor mounting 14 with the integrated pressure damper is screwed onto the damper cover 28 at the cylinder crankcase 10 through the use of fastening devices 32 in the form of screws and bore holes in the compressor mounting 14 as well as threaded holes 29 in the damper cover 28. The compressor mounting 14 has fastening devices 34 in the form of threaded holes and screws for fastening the compressor 12 at the compressor mounting 14. The state when the compressor is mounted can be seen in FIG. 1. Alternatively the screws 34 extend through the boreholes in the compressor mounting 14 and into corresponding threaded holes in the damper cover 28 and, respectively, the cylinder crankcase 10.

The chambers 16 to 24 in the illustrated embodiment are formed to have the following volumes. Chamber 16 has a volume of 1.36 liter, chamber 18 has a volume of 0.21 liter, chamber 20 has a volume of 0.59 liter, chamber 22 has a volume of 0.58 liter, and chamber 24 has a volume of 0.17 liter.

Figure 7:
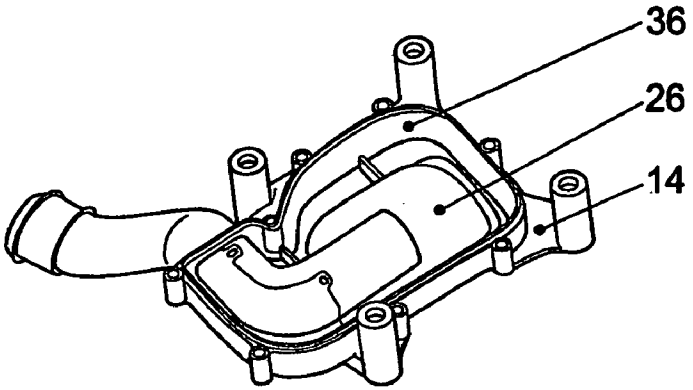
FIG. 7 is a perspective view of the mounting part of FIG. 6 with the inset part inserted in accordance with the invention.
Figure 8:
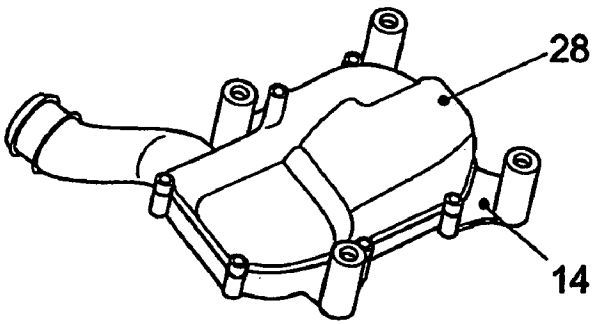
FIG. 8 is a perspective view of the mounting part of FIG. 6 with the damper cover mounted in accordance with the invention.
Figure 6:
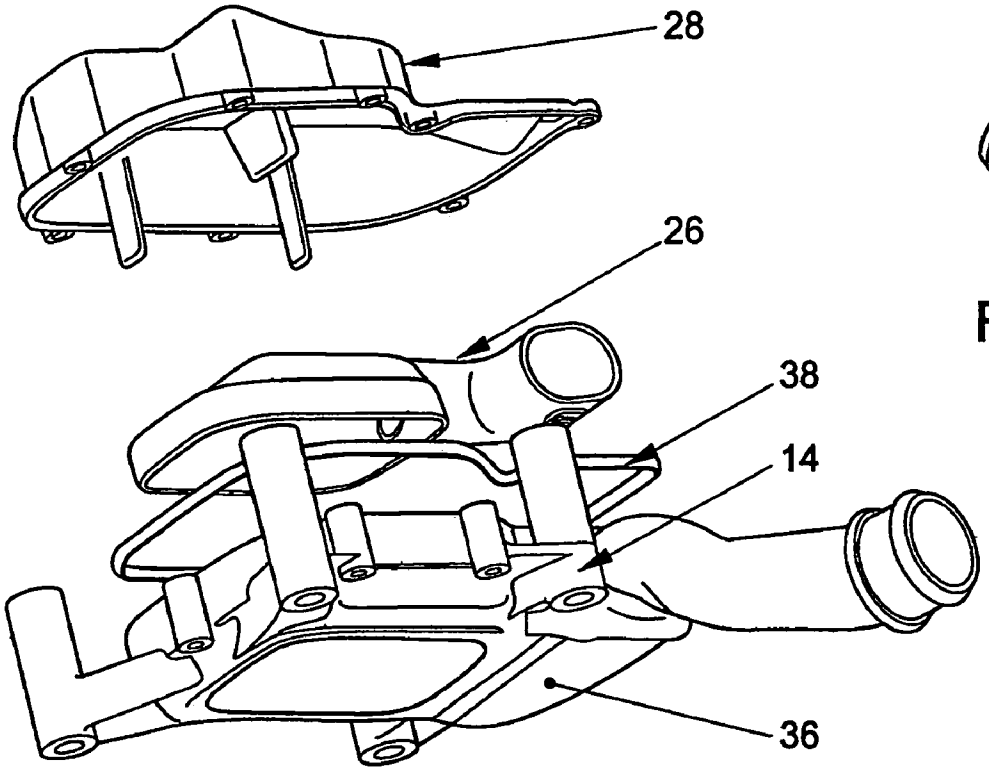
FIG. 6 is an exploded view of on alternative embodiment of the mounting part for an internal combustion engine with an integrated pressure damper in accordance with the invention.

FIGS. 6 to 8 show an alternative embodiment of the compressor mounting 14 with an integrated pressure damper. This compressor mounting 14 includes a mounting part 36, a damper cover 28 fastened to the mounting part 36, an inset part 26 disposed between the mounting part 36 and the damper cover 28, and a gasket 38. In contrast to the first embodiment, the damper cover 28 is not formed as a single piece with the cylinder crankcase, but is a separate component.

Figure 9:
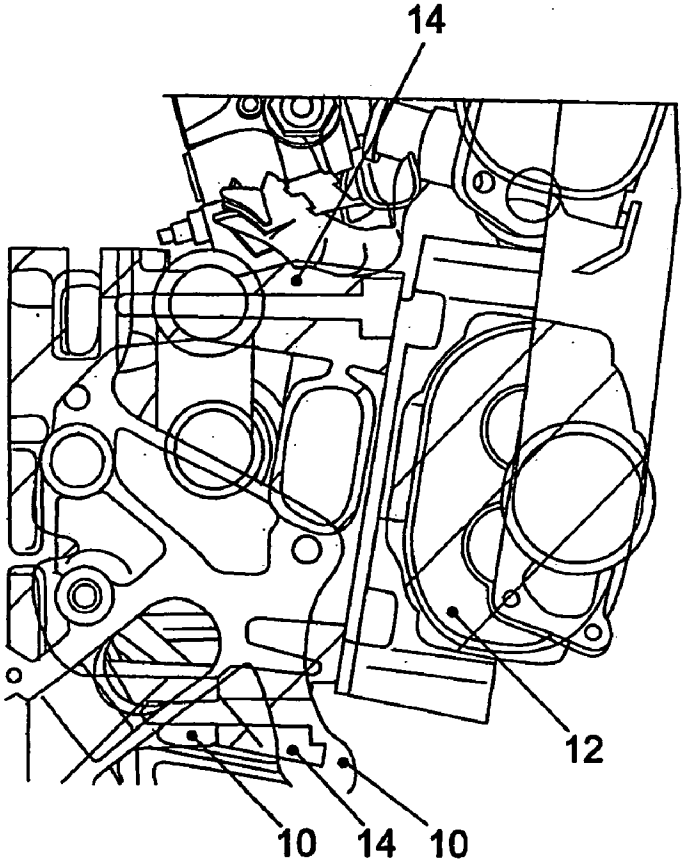
FIG. 9 is a partial sectional view of a second preferred embodiment of the internal combustion engine according to the invention.

FIG. 9 shows a second preferred embodiment of the internal combustion engine with a compressor mounting 14 with an integrated pressure damper according to FIGS. 6 to 8, wherein the compressor mounting 14 is attached to the cylinder crankcase 10 and the compressor 12 is attached to the compressor mounting 14.

Figure 10:
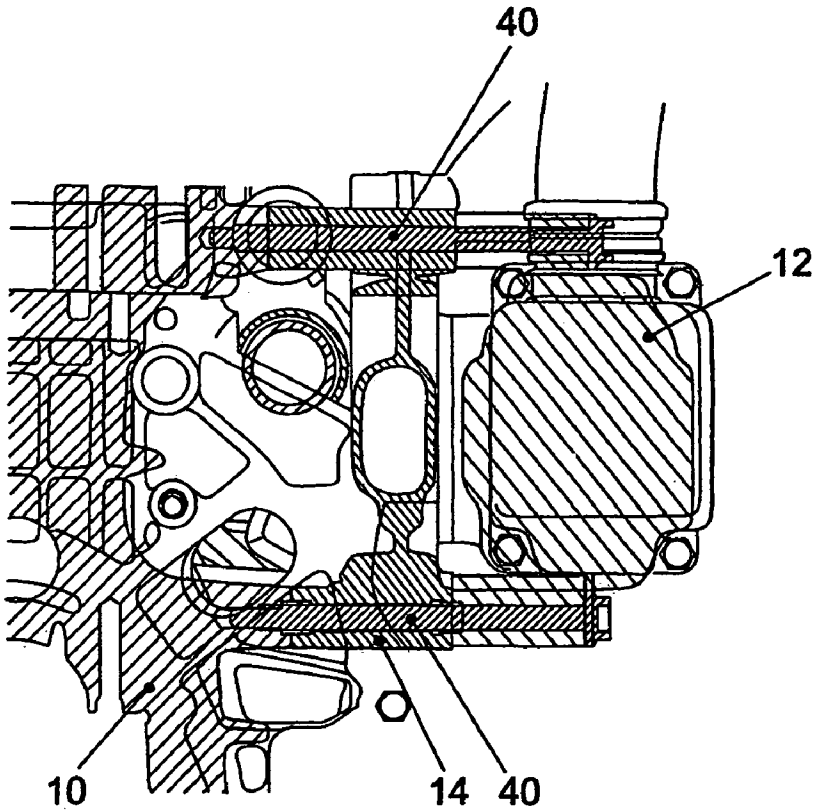
FIG. 10 is a partial sectional view of a third preferred embodiment of the internal combustion engine according to the invention.

FIG. 10 shows a third preferred embodiment of the internal combustion engine according to the invention with a compressor mounting 14 with an integrated pressure damper according to FIGS. 6 to 8, wherein fastening devices 40 are provided, which reach through the compressor 12 and through the compressor mounting 14 into the cylinder crankcase 10 and which fasten the compressor 12 together with the compressor mounting 14 to the cylinder crankcase 10. The fastening devices 40 are for example screws such that the compressor 12 and the compressor mounting 14 are "through-bolted."

What is claimed is:

1. An internal combustion engine, comprising:

a cylinder crankcase;

a mechanically driven compressor for compressing charge air, said compressor being mechanically driven by the internal combustion engine;

a compressor mounting for said compressor, said compressor mounting adjoining said cylinder crankcase;

a pressure damper integrated into said compressor mounting, said pressure damper having chambers formed therein, said chambers being configured to suppress noise emissions; and said pressure damper including a mounting part, a damper cover fastened to said mounting part, and an inset part disposed between said mounting part and said damper cover, said inset part being configured to guide charge air.

2. The internal combustion engine according to claim 1, wherein:

said mounting part is fastened to said cylinder crankcase; and said compressor is fastened to said mounting part.

3. The internal combustion engine according to claim 1, including at least one fastening device reaching through said compressor and through said mounting part and fastening said compressor together with said mounting part at said cylinder crankcase.

4. The internal combustion engine according to claim 1, wherein said damper cover is formed in one piece with said cylinder crankcase.

* * * * *